US011089874B2

(12) United States Patent
Colonello et al.

(10) Patent No.: US 11,089,874 B2
(45) Date of Patent: Aug. 17, 2021

(54) ROTATABLE SEAT CRADLE

(71) Applicant: SIMTEC, INC., Las Vegas, NV (US)

(72) Inventors: Dennis Colonello, Los Angeles, CA (US); James E. Grove, Marina Del Rey, CA (US)

(73) Assignee: SIMTEC, INC., Las Vegas, CA (US)

( * ) Notice: Subject to any disclaimer, the term of this patent is extended or adjusted under 35 U.S.C. 154(b) by 0 days.

(21) Appl. No.: 16/403,954

(22) Filed: May 6, 2019

(65) Prior Publication Data

US 2019/0254430 A1 Aug. 22, 2019

Related U.S. Application Data

(63) Continuation of application No. 14/747,040, filed on Jun. 23, 2015, now Pat. No. 10,314,400.

(51) Int. Cl.
*A47C 1/122* (2006.01)
*A47C 3/025* (2006.01)
(Continued)

(52) U.S. Cl.
CPC ..... *A47C 1/122* (2013.01); *A47C 3/0255* (2013.01); *A47C 3/12* (2013.01); *A47C 7/46* (2013.01)

(58) Field of Classification Search
None
See application file for complete search history.

(56) References Cited

U.S. PATENT DOCUMENTS 1,688,587 A 10/1928 Liljedahl
2,779,389 A 1/1957 Pearl
(Continued)

FOREIGN PATENT DOCUMENTS

DE 9303674 5/1993
GB 2511031 A * 8/2014 ..... A47C 3/0255
(Continued)

OTHER PUBLICATIONS

Non-Final Office Action; Parent U.S. Appl. No. 14/747,040, filed Jun. 23, 2015; dated Mar. 15, 2017.
(Continued)

*Primary Examiner* — David E Allred
(74) *Attorney, Agent, or Firm* — Squire Patton Boggs (US) LLP

(57) ABSTRACT

A seat includes a support having a first coupling hole and a second coupling hole disposed therein. The seat also includes a seat cradle having a back, a bottom, a first side fixedly connected to the back and the bottom, and a second side fixedly connected to the back and the bottom. The seat cradle has a neutral position in which a top portion of the back is positioned forward of a bottom portion of the back, and a rear portion of the bottom is positioned below a forward position of the bottom. The seat also has a first cradle coupler extending from the first side of the seat cradle, such that the first cradle coupler cannot rotate with respect to the first side. The seat further includes a second cradle coupler extending from the second side of the seat cradle, such that the second cradle coupler cannot rotate with respect to the second side. The first cradle coupler is received in the first coupling hole and the second cradle coupler is received in the second coupling hole.

17 Claims, 8 Drawing Sheets

(51) Int. Cl.
*A47C 3/12* (2006.01)
*A47C 7/46* (2006.01)

(56) References Cited

U.S. PATENT DOCUMENTS

| | | | | |
|---|---|---|---|---|
| 3,142,514 | A | 7/1964 | Ginat | |
| 3,711,152 | A | 1/1973 | Sirpak | |
| 4,500,137 | A | 2/1985 | Morehouse | |
| 4,529,247 | A * | 7/1985 | Stumpf | A47C 3/026 297/285 |
| 4,545,613 | A | 10/1985 | Martel | |
| 4,852,945 | A | 8/1989 | Rowles et al. | |
| 5,024,485 | A | 6/1991 | Berg | |
| 5,333,934 | A | 8/1994 | Knoblock | |
| 5,368,359 | A | 11/1994 | Eakin | |
| 5,383,709 | A | 1/1995 | Chaney | |
| 5,509,719 | A | 4/1996 | Cone, II | |
| 5,516,134 | A | 5/1996 | Crawford | |
| 5,540,481 | A | 7/1996 | Roossien | |
| 5,738,409 | A * | 4/1998 | Bursik | A47C 3/02 297/265.1 |
| 5,984,409 | A | 11/1999 | Eakin | |
| 6,050,642 | A | 4/2000 | Erb | |
| 6,168,233 | B1 | 1/2001 | Markus | |
| 6,325,455 | B1 | 12/2001 | Chung | |
| 6,394,547 | B1 | 5/2002 | Vik | |
| 6,974,188 | B2 | 12/2005 | Turner | |
| 7,677,663 | B1 | 3/2010 | Charles | |
| 7,850,238 | B2 | 12/2010 | Erb | |
| 8,157,327 | B2 | 4/2012 | Tomasi | |
| 8,668,273 | B2 | 3/2014 | Wang | |
| 8,671,482 | B2 | 3/2014 | Willingham | |
| 8,926,017 | B2 | 1/2015 | Grove | |
| 8,979,201 | B2 | 3/2015 | Erb | |
| 9,427,086 | B2 * | 8/2016 | Willingham | A47C 3/12 |
| 2005/0059502 | A1 | 3/2005 | Greger | |
| 2007/0057562 | A1 | 3/2007 | Gregory et al. | |
| 2007/0222266 | A1 | 9/2007 | Lucci | |
| 2008/0303232 | A1 | 12/2008 | Chen | |
| 2009/0188410 | A1 * | 7/2009 | Billich | A47C 3/0255 108/4 |
| 2009/0282615 | A1 * | 11/2009 | Prosch | A47C 3/0255 5/607 |
| 2010/0253122 | A1 | 10/2010 | Okimoto et al. | |
| 2010/0269352 | A1 | 12/2010 | Curtin | |
| 2012/0299350 | A1 | 11/2012 | Willingham | |
| 2014/0062153 | A1 | 3/2014 | Grove et al. | |
| 2014/0361591 | A1 * | 12/2014 | Kuno | B60N 2/1695 297/325 |
| 2015/0015042 | A1 | 1/2015 | Willingham | |

FOREIGN PATENT DOCUMENTS

| | | |
|---|---|---|
| JP | 36-010998 | 5/1961 |
| JP | 60-069057 | 5/1985 |
| JP | 63-057958 | 4/1988 |

OTHER PUBLICATIONS

Final Office Action; Parent U.S. Appl. No. 14/747,040, filed Jun. 23, 2015; dated Jul. 14, 2017.
Non-Final Office Action; Parent U.S. Appl. No. 14/747,040, filed Jun. 23, 2015; dated Nov. 14, 2017.
Final Office Action; Parent U.S. Appl. No. 14/747,040, filed Jun. 23, 2015; dated May 4, 2018.
Non-Final Office Action; Parent U.S. Appl. No. 14/747,040, filed Jun. 23, 2015; dated Aug. 27, 2018.
Examination Report; Corresponding AU Application Serial No. 2016284054; dated Aug. 13, 2020.
Extended Search Report; Corresponding EP Application Serial No. 16815129.8; dated Jun. 15, 2021.

* cited by examiner

ROTATABLE SEAT CRADLE

CROSS-REFERENCE TO RELATED APPLICATION

This application claims priority to U.S. patent application Ser. No. 14/747,040 filed on Jun. 23, 2015, the disclosure of which is incorporated by reference herein, in its entirety.

FIELD OF THE INVENTION

This invention relates to a posture-improving seat cradle that, in a preferred embodiment, is pivotally connected and rotatable relative to a stand connected to the ground or to a yoke connected to a chair base. The rotatable seat cradle is configured to unload a user's upper body weight from his pelvic sacroiliac joints while promoting a neutral spine sitting posture and inducing anterior pelvic tilt and lumbar lordosis so as to maximize the user's comfort and posture while seated.

BACKGROUND

Back pain is an epidemic health problem suffered by a majority of individuals at some point in their lives. The American Academy of Pain Medicine estimates that back pain costs Americans billions of dollars yearly, with back pain second only to the common cold in office visits to the doctor. It has long been known that back pain is one of many side effects attributed to prolonged sitting posture. Neutral spine posture is considered by experts in the field of ergonomics to be the optimal sitting posture. Anatomically, neutral spine posture is defined as the optimum spinal curvature wherein the cervical and lumbar divisions of the spine are moderately convex anteriorly (lordosis) and the thoracic and sacral divisions of the spine are moderately convex posteriorly (kyphosis).

In an unaided and unconscious seated posture, the tendency is for the sitter's pelvis to rock posteriorly on the seat surface, secondary to the sacral kyphosis, thereby initiating a reflex alordosis of the lumbar spine. Alordosis of the lumbar spine induces reflex concomitant postural compensations of both the thoracic and cervical spine divisions potentially leading to upper back and neck pain. It is well documented that alordosis of the lumbar spine results in a shift of the body's center of gravity forward of the neutral postural gravity line, thereby adversely loading the lumbar spine disc structures and predisposing the sitter to lower back pain. Many working in the field of ergonomics agree that neutral spine posture is the optimum sitting posture. Many also agree that neutral spine posture is facilitated by promoting both anterior pelvic tilt and lumbar lordosis. Traction of the spine has long been generally accepted as an effective method for alleviating back pain. Traction of the spine unloads the soft and hard tissue structures of the spine thereby relieving these tissues from the compressive forces associated with prolonged sitting which may relieve the pain associated therewith.

As far as can be determined, a rotatable seat cradle is unknown having a leg support front portion inclined upwardly from a pelvic support intermediate portion and further including a lumbar spine support back portion such that a rotation of the seat cradle in response to a forward leaning sitter promotes dynamic anterior pelvic tilt and dynamic lumber lordosis while simultaneously unloading the sitter's upper body weight from his pelvis for effectively positioning of the sitter's back towards a neutral spine seated posture.

SUMMARY

In one embodiment, a rotatable seat has a one-piece seat cradle. The one-piece seat cradle includes a front portion, a back portion having a top, and a bucket portion disposed between the front portion and the back portion. The bucket portion has a bottom. The one-piece seat cradle further has a pair of sides extending upwards from the bucket portion. The pair of sides includes a first side and a second side spaced from and opposite the first side. The one-piece seat cradle also has a pair of cradle couplers including a first cradle coupler extending from the first side at a location between the top of the back portion and the bottom of the bucket portion, and a second cradle coupler extending from the second side at a location between the top of the back portion and the bottom of the bucket portion. The pair of cradle couplers cannot rotate with respect to the pair of sides of the one-piece seat cradle. The rotatable seat further includes a support structure having a first coupling hole and a second coupling hole. The first coupling hole receives the first cradle coupler and the second coupling hole receives the second cradle coupler, such that the pair of cradle couplers rotate within the first and second coupling holes and the one-piece seat cradle rotates freely in forward and rearward directions relative to the support structure. The one-piece seat cradle is not otherwise connected to the support structure. The one-piece seat cradle has a neutral position in which the back portion is substantially vertical and the bottom of the bucket portion is substantially horizontal.

In another embodiment, a seat includes a base and a seat cradle connected to the base. The seat cradle has a back, a front, an intermediate bucket between the back and the front, and a pair of sides spaced from and lying opposite one another and extending between the back and the front. When the seat cradle is in a neutral position, a portion of the back of the seat cradle projects inwardly towards the front of the seat cradle so to lie closer to the front than a portion of the intermediate bucket that lies below the inwardly projecting back portion of the seat cradle. When the seat cradle is in the neutral position, the front of the seat cradle lies above a bottom of the intermediate bucket and has a sloping portion that extends upwardly from the intermediate bucket. The seat further includes a yoke connected between the base and the seat cradle and having a pair of upright struts between which the seat cradle is held. Each of the pair of upright struts has a coupling hole formed therein. The seat also includes a pair of cradle couplers, wherein each cradle coupler is a part of the seat cradle. Each cradle coupler is located within a respective coupling hole, such that the seat cradle is connected to the base by the pair of cradle couplers, and not otherwise connected to the base, such that the seat cradle is suspended above a portion of the base. The cradle couplers are rotatable within respective ones of the coupling holes to establish pivots at which the seat cradle freely rotates when a user leans forward and back.

In yet another embodiment, a seat includes a support having a first coupling hole and a second coupling hole disposed therein. The seat also includes a seat cradle having a back, a bottom, a first side fixedly connected to the back and the bottom, and a second side fixedly connected to the back and the bottom. The seat cradle has a neutral position in which a top portion of the back is positioned forward of a bottom portion of the back, and a rear portion of the bottom is positioned below a forward position of the bottom. The seat also has a first cradle coupler extending from the first side of the seat cradle, such that the first cradle coupler cannot rotate with respect to the first side. The seat further includes a second cradle coupler extending from the second side of the seat cradle, such that the second cradle coupler cannot rotate with respect to the second side. The first cradle coupler is received in the first coupling hole and the second cradle coupler is received in the second coupling hole, such that the seat cradle is connected to the support by the first cradle coupler and the second cradle coupler, and is not otherwise connected to the support, such that the seat cradle is suspended above a portion of the support, and such that the first and second cradle couplers freely rotate within the first and second coupling holes.

DETAILED DESCRIPTION

Figure 1:
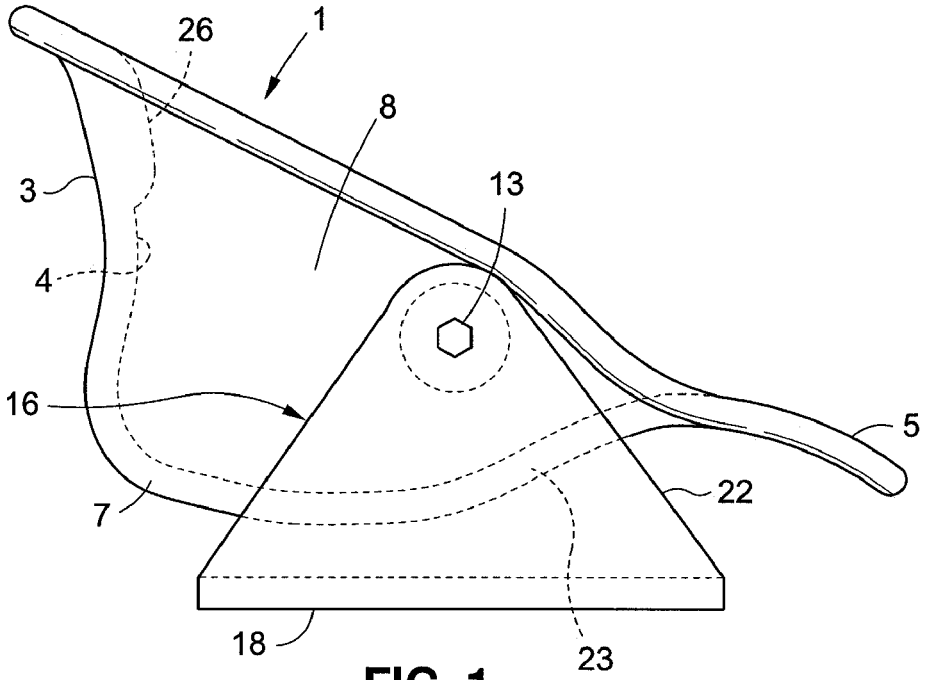
FIG. 1 is a side view of a rotatable seat cradle coupled to and rotatable relative to a stand in accordance with a first seating application.
Figure 2:
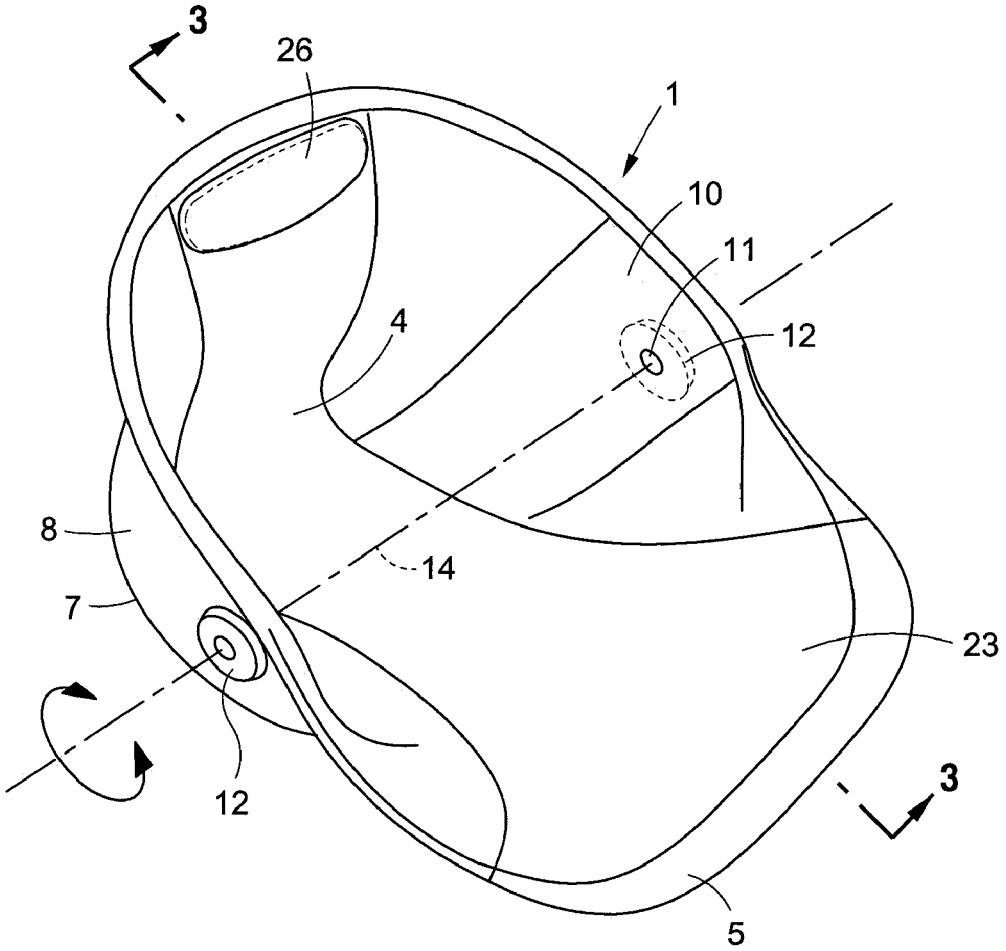
FIG. 2 is a perspective view of the rotatable seat cradle shown in FIG. 1 being rotatable around a pivot axis.

Referring initially to FIGS. 1-5 of the drawings, there is shown a first preferred embodiment for a simple, low cost rotatable seat cradle 1 which offers the advantages of this invention. The seat cradle 1 is ideally manufactured as a one-piece shell from conventional blow-molded or injection-molded plastic. The seat cradle 1 includes a generally upright lumbar supporting back 3 against which the back of a user seated in the cradle is received. The seat cradle 1 also includes a thigh supporting front 5 located at the forward leading edge of cradle 1 opposite the lumbar supporting back 3. The user's legs rest upon the thigh supporting front 5. Located between the lumbar-supporting back 3 and the thigh-support front 5 of the seat cradle 1 is a deep, generally U-shaped pelvic support bucket 7 within which the seated user's pelvis is received. The user's lower spine is engaged by a portion 4 of the lumbar-supporting back 3 that is molded into the seat cradle 1 so as to project inwardly and forwardly towards the thigh-supporting front 5 so as to lie ahead of an adjacent rearwardly projecting portion of the pelvic support bucket 7 (best shown in FIG. 5).

Figure 3:
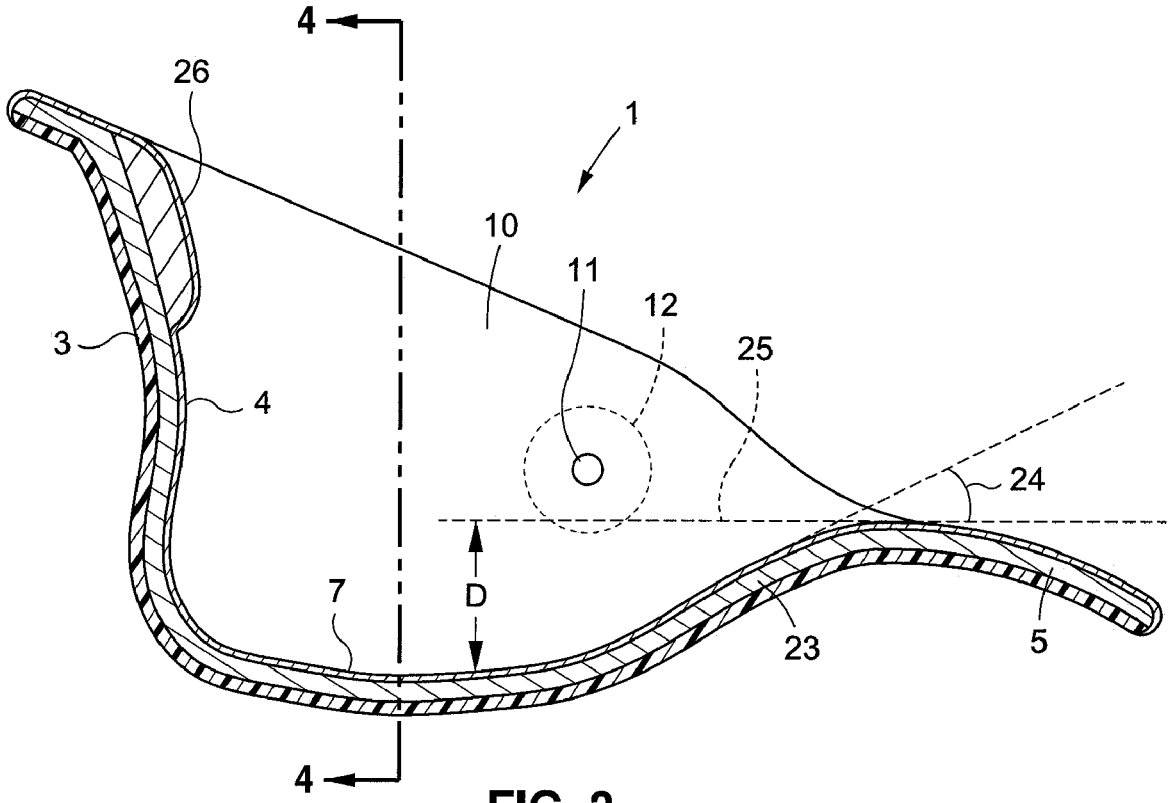
FIG. 3 is a cross-section of the rotatable seat cradle taken along lines 3-3 of FIG. 2.
Figure 4:
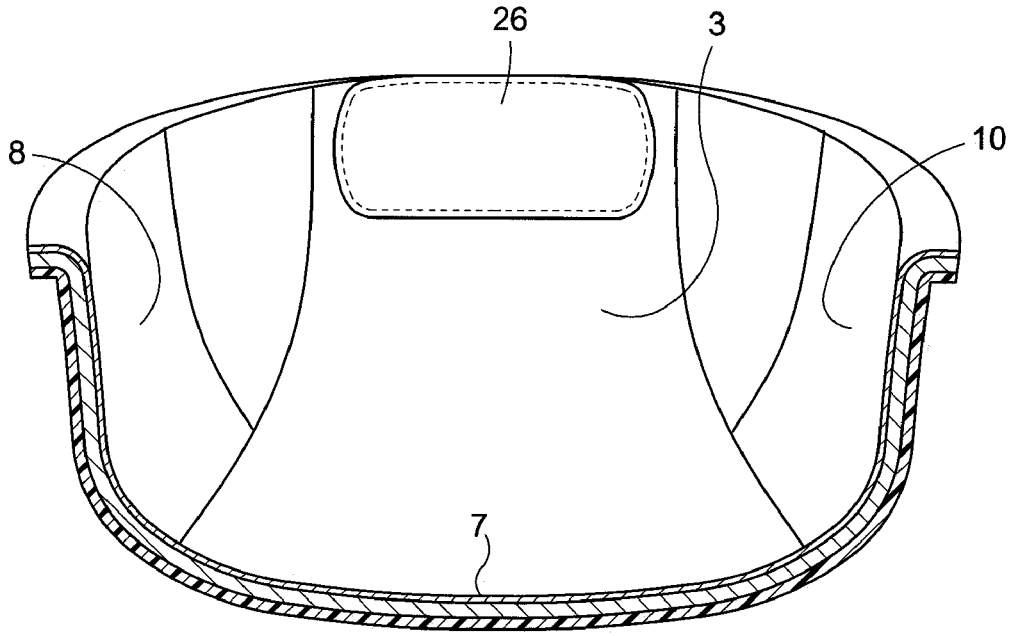
FIG. 4 is cross-section of the rotatable seat cradle taken along lines 4-4 of FIG. 3.

The seat cradle 1 has a pair of opposing side walls 8 and 10 that are co-extensive to and rise vertically above the pelvic support bucket 7. A pair of axially-aligned holes (only one of which 11 being shown in FIGS. 2 and 3) are formed through the side walls 8 and 10 of seat cradle 1. A pivot support bushing 12 is affixed to the outside of each of the side walls 8 and 10 so as to surround and reinforce the axially-aligned holes 11 formed therethrough. The holes 11 and pivot support bushings 12 at the opposite side walls 8 and 10 of the rotatable seat cradle 1 are positioned to receive respective pivots (e.g., shoulder bolts, only one of which 13 being shown in FIG. 1) therewithin by which to establish a linear pivot axis 14 (best shown in FIG. 2) around which the seat cradle 1 can rotate in response to a rotational force applied thereto. The linear pivot axis 14 runs laterally across the seat cradle 1 between the side walls 8 and 10 thereof in substantial axial alignment with the hip joints of the user so that the cradle 1 will be equally weighted on opposite sides of the pivot axis and thereby balanced in a neutral position as shown in FIGS. 1 and 3 when the cradle is empty.

Figure 5:
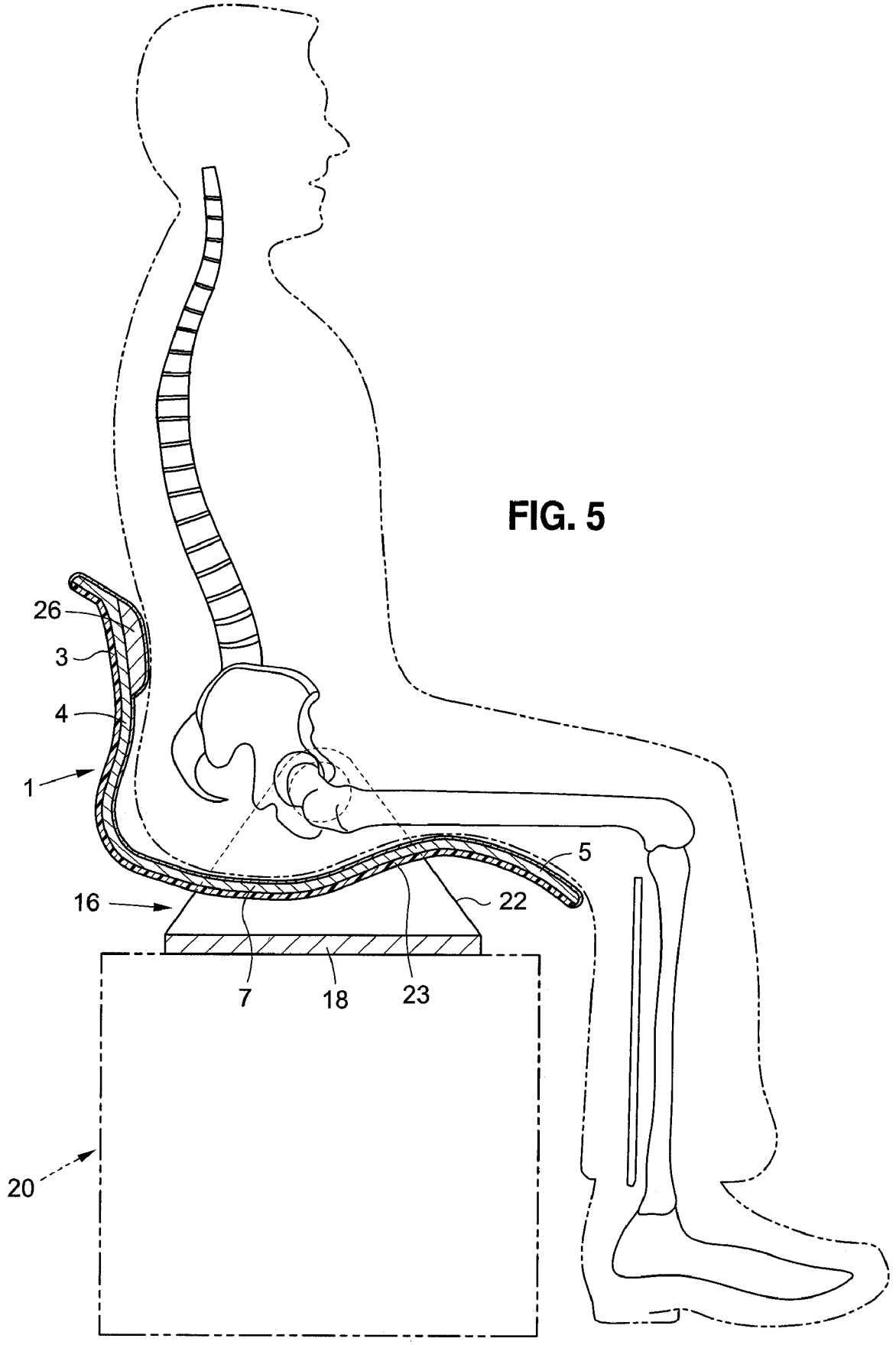
FIG. 5 is a cross-section of the rotatable seat cradle and the stand of FIG. 1 lying atop an elevated support surface.

As is best shown in FIGS. 1 and 5, the rotatable seat cradle 1 is pivotably coupled to a stand 16. The particular stand 16 to which the seat cradle is coupled is not to be considered a limitation of this invention. By way of example only, the stand 16 of FIGS. 1 and 5 includes a flat base 18 that is either laid on or affixed to any suitable flat surface (represented diagramatically by reference numeral 20 of FIG. 5). The shape and elevation (if any) of the surface 20 upon which the rotatable seat cradle 1 is laid are matters of choice depending upon the application of the seat cradle.

A pair of upright braces (only one of which 22 being shown in FIGS. 1 and 5) project vertically upward from respective opposite ends of the flat base 18 of stand 16. Each upright brace 22 holds one of the aforementioned pivots (e.g., shoulder bolts 13) that is surrounded and supported by one of the outside pivot support bushings 12 at a corresponding one of the side walls 8 and 10 of seat cradle 1. In this manner, the rotatable seat cradle 1 is suspended by the stand 16 above the flat base 18 thereof so as to be capable of rotating back and forth around the pivot axis 14 (of FIG. 2) relative to the stand 16 and the surface (e.g., 20) upon which the stand is laid or affixed.

As an important detail of the rotatable seat cradle 1, in its neutral position shown in FIGS. 1, 3 and 5, the bottom of the pelvic support bucket 7 which is the closest to the support surface lies below the top of the thigh supporting front 5. More particularly, an upwardly sloping transition wall 23 extends continuously and co-extensively between the pelvic support bucket 7 and the thigh supporting front 5. The transition point at which the upwardly sloping transition wall 23 joins the thigh supporting front 5 is spaced above the bottom of the pelvic support bucket 7 by a distance (designated Din FIG. 3) which is dependent upon the size of the expected user. That is, the distance D of the seat cradle 1 will be shorter for small children and larger for big and/or tall individuals.

What is more, the slope of the upwardly sloping transition wall 23 forms an ideal angle (designated 24 in FIG. 3) of equal to or less than 45 degrees with respect to a horizontal reference line 25 through the aforementioned transition point at which the upwardly sloping transition wall 23 joins the thigh supporting front 5. Thus, the thigh supporting front 5 of cradle 1 cantilevers outwardly from the upwardly sloping transition wall 23 at the forward leading edge of the cradle. Accordingly, a forward movement of the user seated in the rotatable cradle 1 results in the legs of the user applying a corresponding rotational pushing force in a clockwise direction against the cantilevered thigh supporting front 5, whereby the cradle will rotate around the pivot axis 14 (of FIG. 2) relative to the stand 16 to which the cradle is pivotally coupled.

Referring specifically to FIG. 5 of the drawings, a user is shown seated within the rotatable seat cradle 1 with his back lying against the lumber support back 3, his legs resting upon the cantilevered thigh supporting front 5, and his pelvis received by the pelvic support bucket 7. The seat cradle 1 is in its neutral, weight balanced position ready to rotate in the clockwise direction should the user shift his weight forward and thereby apply the aforementioned pushing force against the thigh supporting front 5 as was just explained.

An optional posture correcting pad 26 extends inwardly from the lumbar supporting back 3 of the seat cradle 1 to engage the user's lower back and urge the user's spine into an erect posture. In this same regard, when the user shifts his weight forward in seat cradle 1 towards the thigh supporting front 5, the corresponding clockwise rotation of the seat cradle 1 lifts the user's lumbar and pelvis upwardly and forwardly so as to dynamically induce lumbar lordosis and anterior pelvic tilt. By virtue of the foregoing, the user's posture within cradle 1 is advantageously positioned towards a neutral spine posture. The rotation of the seat cradle 1 nudges the forwardly projecting portion 4 of the lumbar support back 3 into the user's lower back to provide an upward and forward traction force to the user's lumbar spine in a direction away from the pelvis in order to substantially unload the user's body weight from his seated pelvis. In the alternative, the forward projecting portion 4 of the lumbar support back 3 can be made flat and eliminated, and the posture correcting pad 26 can be sized and positioned to protrude towards the thigh supporting front 5 for receipt in the user's lower back. In either case, the rotatable seat cradle 1 herein disclosed is adapted to improve both the posture and comfort of the seated user.

Figure 6:
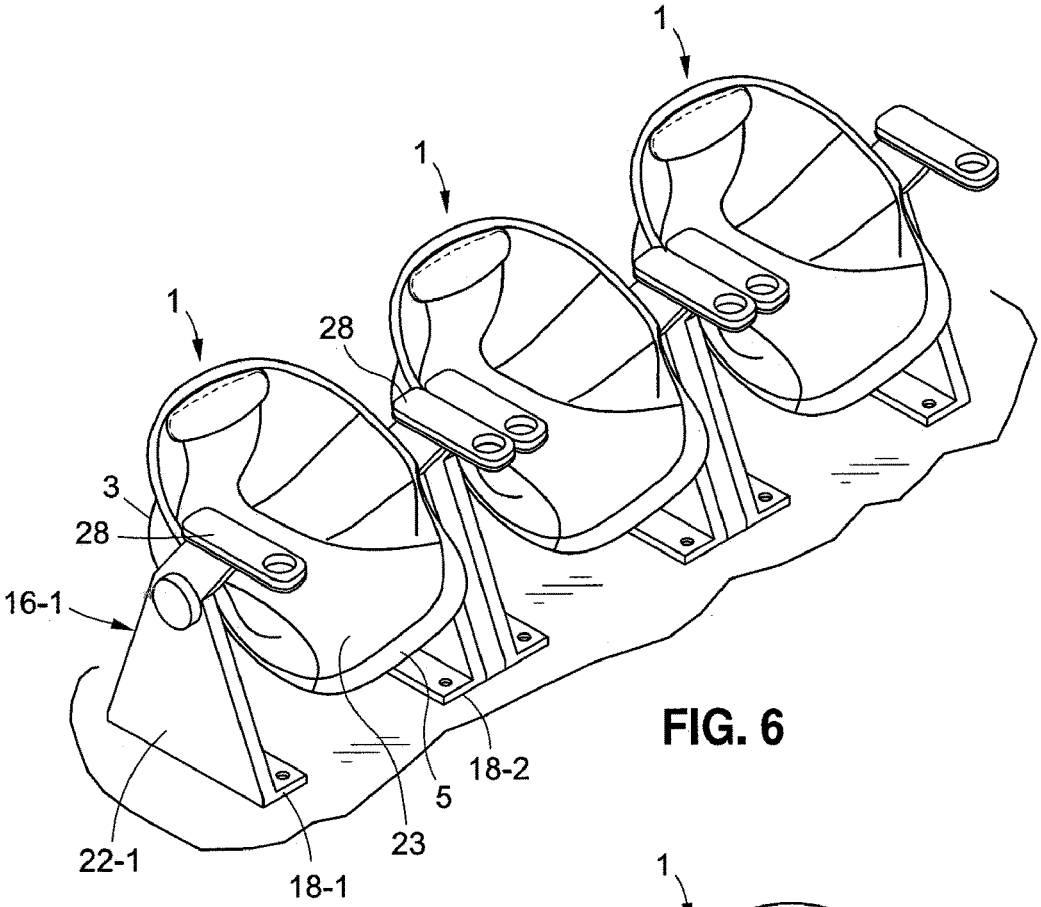
FIG. 6 shows a plurality of rotatable seat cradles located at a neutral seating position relative to a corresponding plurality of stands to which the seat cradles are coupled in accordance with a second seating application.
Figure 7:
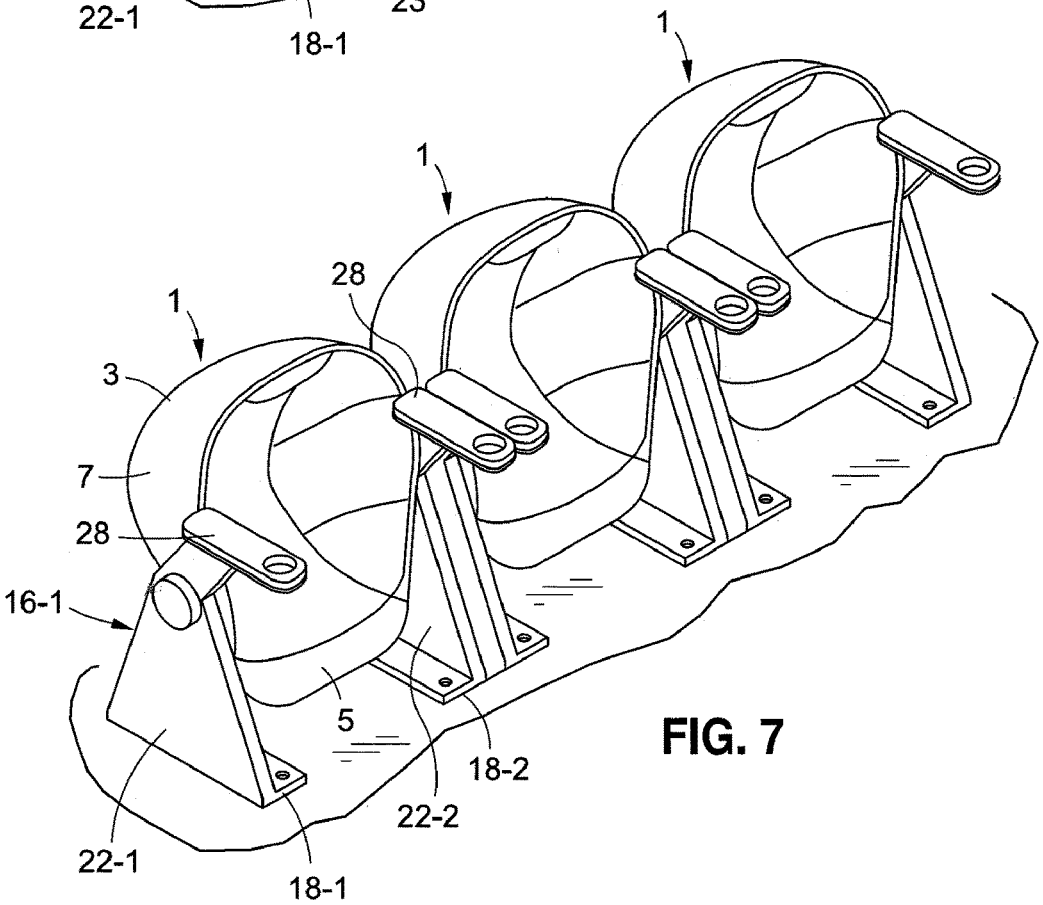
FIG. 7 shows the plurality of rotatable seat cradles of FIG. 6 rotated relative to the stands to a stowed position.

FIGS. 6 and 7 of the drawings show one example of a seating application for the rotatable seat cradle 1 that has been described while referring previously to FIGS. 1-5. In FIGS. 6 and 7, the seat cradle 1 is combined with a plurality of identical seat cradles aligned side-by-side one another to create a comfortable outdoor or indoor group seating arrangement for a corresponding number of occupants at a stadium, theater, airport waiting room, or the like. FIG. 6 shows each of the plurality of seat cradles 1 in its neutral, weight balanced position ready for occupancy. FIG. 7 shows the seat cradles 1 rotated around their pivot axes 14 (of FIG. 2) in a downward clockwise direction to a compact stowed position when the seat cradles are unoccupied. Of course, different ones of the plurality of rotatable seat cradles 1 can be selectively rotated to the neutral and the stowed positions of FIGS. 6 and 7 depending upon the number of occupants.

In the example shown in FIGS. 6 and 7, each seat cradle 1 is pivotally coupled to and suspended above the ground by a pair of stands 16-1 and 16-2 which are held in spaced facing alignment like those illustrated in FIGS. 1 and 5 so that a corresponding pair of vertically-upright braces 22-1 and 22-2 are located at opposite sides of the cradle. Flat bases 18-1 and 18-2 extend horizontally from respective ones of the pair of braces 22-1 and 22-2 of the stands 16-1 and 16-2 to be affixed to the ground. Thus, it may be appreciated that the elevated surface 20 shown in FIG. 5 upon which the seat cradle 1 is laid is now eliminated. An optional pair of arms 28 are attached to respective ones of the pair of upright braces 22-1 and 22-2 upon which the arms of one seated in the seat cradle may rest.

FIGS. 8-11 of the drawings illustrate another seating application for the rotatable seat cradle 1 that was previously described while referring to FIGS. 1-5. Identical reference numerals are used to designate identical features of the seat cradle 1 shown in FIGS. 1-5 and FIGS. 8-11. In its simplest application, the seat cradle 1 need not be pivotally coupled to a stand like that shown in FIGS. 1, 6 and 7. In this case, the seat cradle 1 may simply be placed upon and removed from a conventional chair such as, for example, that designated 30 in FIG. 11. Thus, the lumbar supporting back 3 of the seat cradle 1 lies adjacent the back 32 of the chair 30, and the thigh supporting front 5 of cradle 1 rests on the front of the chair seat 34. The pelvic support bucket 7 of the seat cradle 1 is shown lying against both the bottom of the chair back 32 and the rear of the chair seat 34. One seated and shifting his weight in the seat cradle 1 that has been placed on the chair 30 of FIG. 11 will advantageously receive the posture improving benefits described above which are not always available while sitting and rocking in the chair alone.

Figure 8:
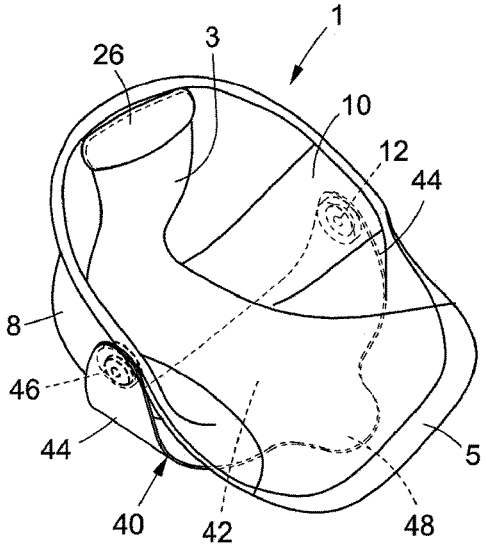
FIGS. 8 and 9 show the rotatable seat cradle of FIG. 1 pivotally coupled to and rotatable relative to a yoke in accordance with a different seating application.
Figure 9:
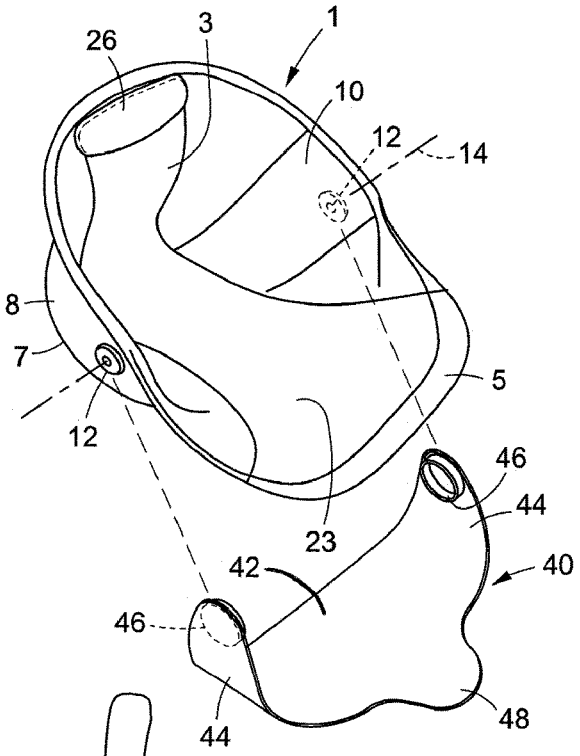
Figure 10:
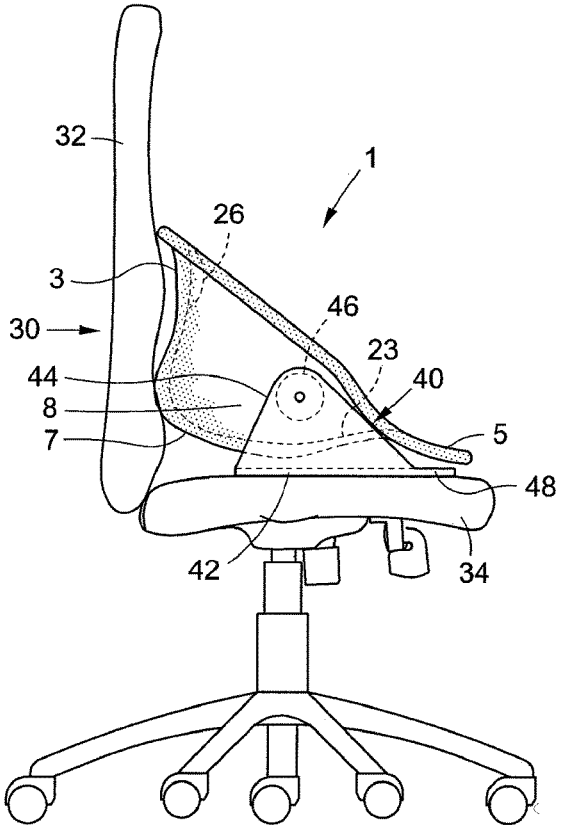
FIG. 10 shows the rotatable seat cradle and yoke of FIGS. 8 and 9 laid upon the seat of a conventional chair.
Figure 11:
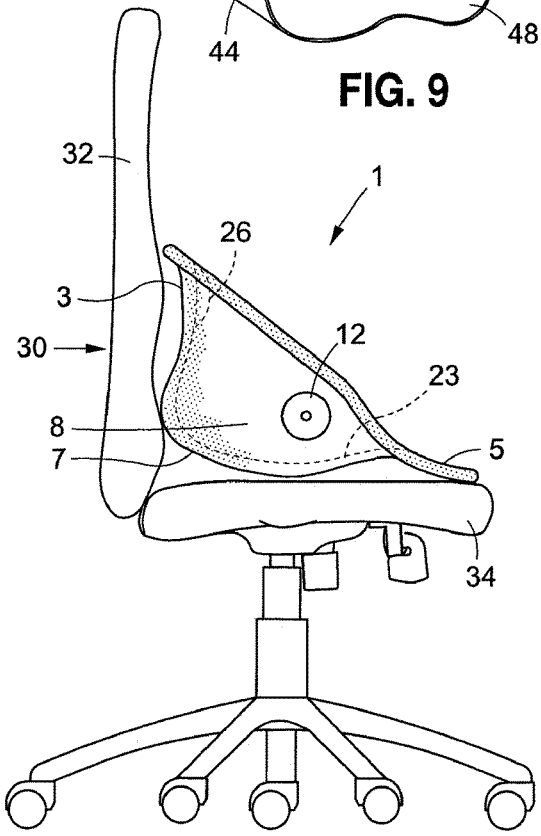
FIG. 11 shows the rotatable seat cradle of FIG. 1 laid upon the seat of a conventional chair in accordance with another seating application.
Figure 12:
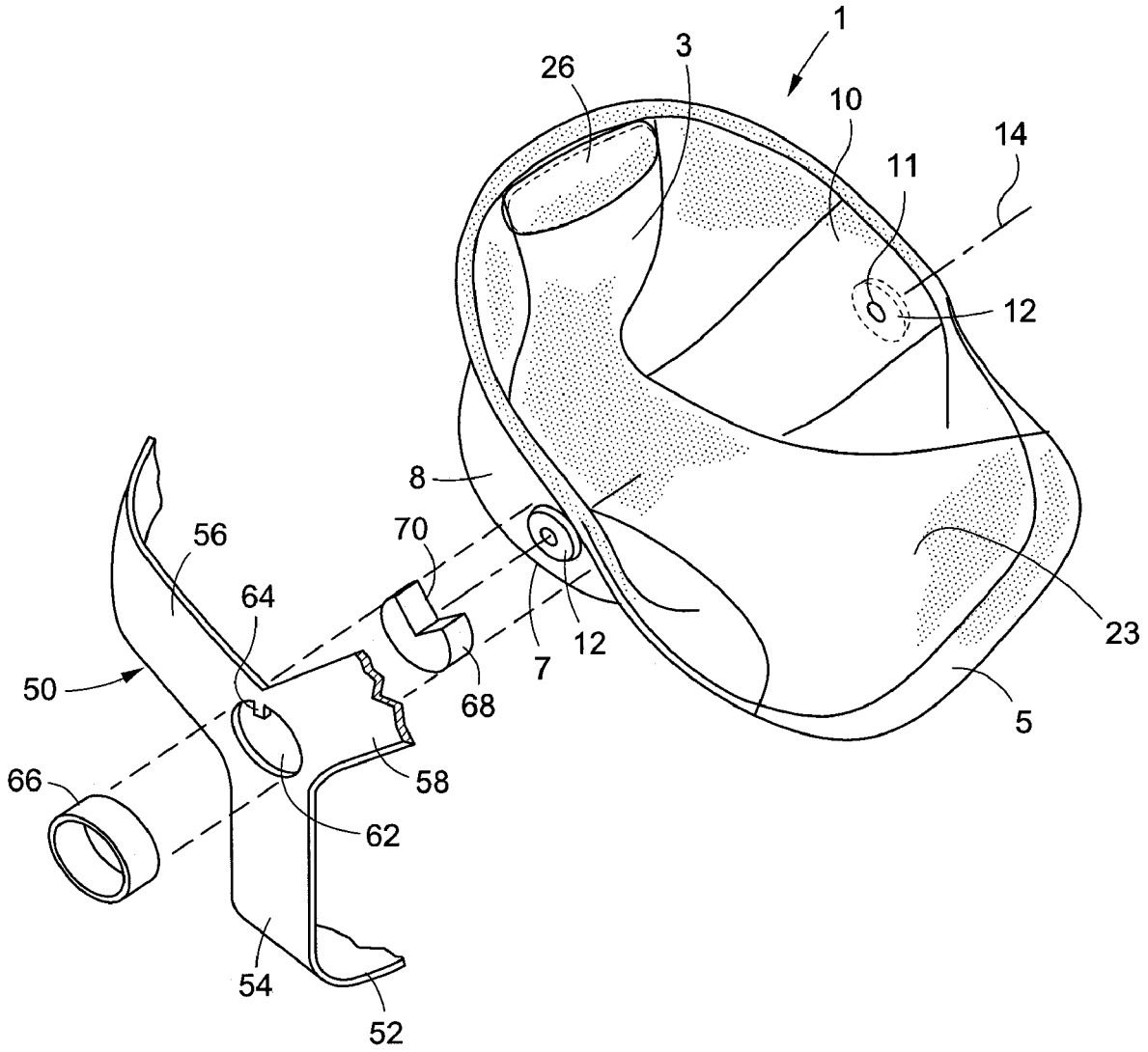
FIG. 12 is an exploded view showing the rotatable seat cradle of FIG. 1 being coupled to and rotatable relative to a yoke in accordance with yet another seating application.

Rather than being pivotally coupled to the stand 16 shown in FIGS. 1, 6 and 7, the rotatable seat cradle 1 can be seated on and removed from the chair 30 while coupled to a yoke 40 as shown in FIGS. 8, 9 and 10. The yoke 40 is preferably manufactured from a flexible plastic and includes a relatively flat base 42 and a pair of upturned side walls 44 lying in spaced opposing alignment with one another and having a spring memory. A pair of cylindrical couplers 46 face inwardly towards one another from the upturned side walls 44. The yoke 40 includes a frontal nose 48 that projects outwardly from the base 42 to lend support and stability to the base when the yoke is seated on the chair 30 as shown in FIG. 10.

The rotatable seat cradle 1 is pivotally and detachably coupled to the yoke 40 as shown in FIG. 8 by first bending the flexible side walls 44 of the yoke 40 outwardly and then locating the cylindrical couplers 46 thereof in surrounding engagement with respective ones of the pivot support bushings 12 (best shown in FIG. 9) which project from the side walls 8 and 10 of the seat cradle. The combination of the seat cradle 1 and the yoke 40 is placed on the seat 34 of the chair 30 such that the flat base 42 and the frontal nose 48 extending therefrom lie flush against the seat, and (as in the case of the seating arrangement shown in FIG. 11) the lumbar supporting back 3 of cradle 1 lies adjacent the chair back 32. When the user shifts his weight forward and back in the seat cradle 1, the seat cradle will rotate around its pivot axis (designated 14 in FIG. 9) relative to the yoke 40 to impart a corresponding force to the chair 30. However, the user is advantageously provided with the posture improving benefit offered by the rotatable seat cradle 1 as described above which is not always available from the chair alone.

Figure 13:
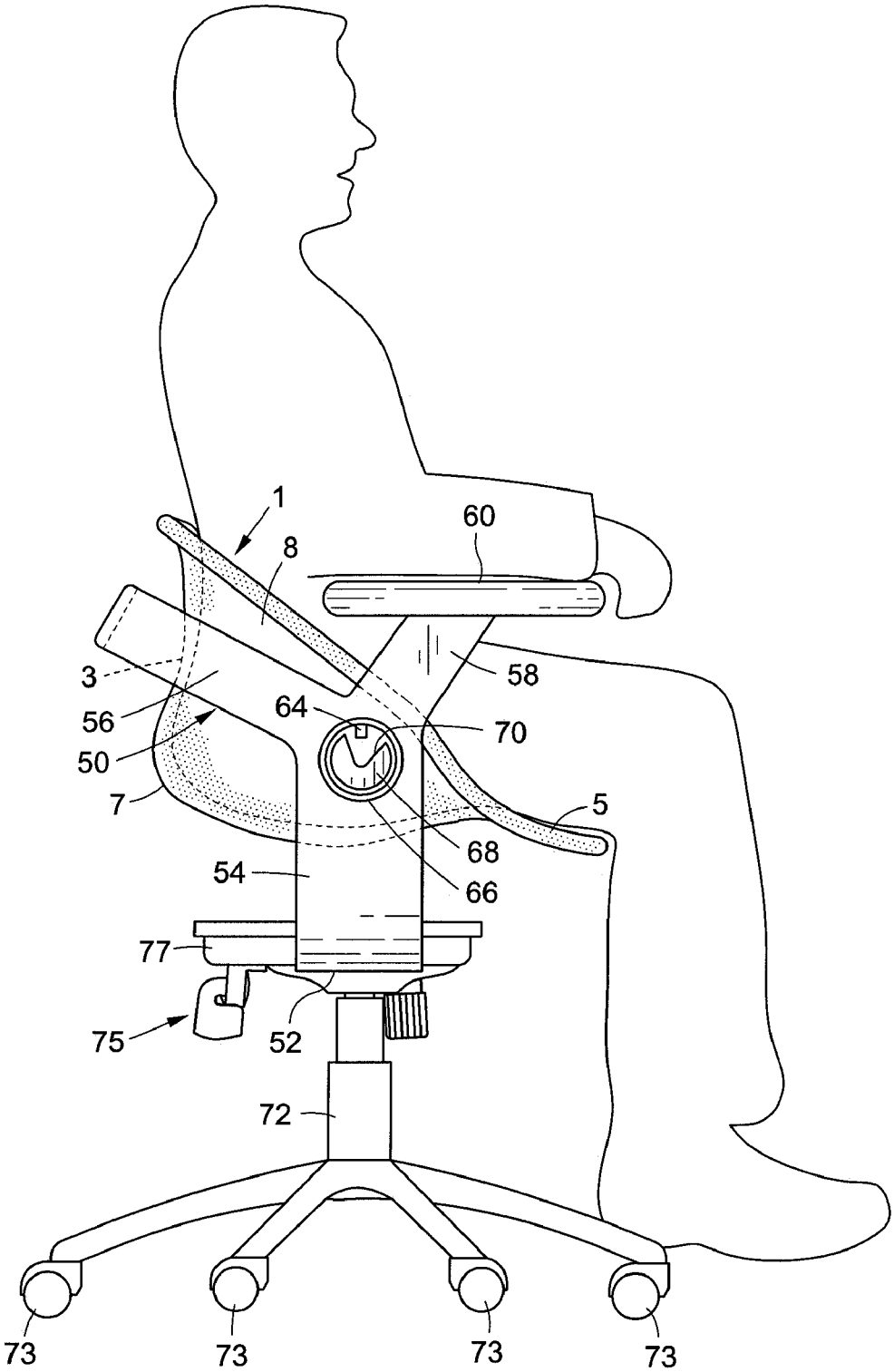
FIG. 13 shows the rotatable seat cradle pivotally coupled to the yoke of FIG. 12 and the yoke connected to the base of a conventional chair in place of the usual seat.

Turning now to FIGS. 12-17 of the drawings, the rotatable seat cradle 1 herein disclosed is shown in another seating application while being attached to a different chair (designated 75 and best shown in FIG. 13). In this case, the seat cradle 1 is coupled to and rotatable relative to a yoke 50, and the yoke 50 is affixed to the chair 75. Once again, identical reference numerals have been used to designate identical features of the seat cradle 1 illustrated in FIGS. 12-17. As will now be disclosed, the seat cradle 1 is attached to the existing base 72 of the chair 75 by means of the yoke 50 so as to replace the usual seat of the chair.

The yoke 50 includes a U-shaped base 52 lying at the bottom thereof and a pair of upturned vertically-extending struts 54 arranged in spaced facing alignment with one another. Co-extensively connected to and extending in a first direction from each upturned strut 54 at each side of the yoke 50 is an outstretched cradle support arm 56. Co-extensively connected to and extending in a second direction from each strut 54 is an arm pad support brace 58. The co-extensively-connected cradle support arm 56 and arm pad supporting brace 58 extend from each of the upturned struts 54 of yoke 50 in the first and second directions to form an angle therebetween of about 90 degrees.

In the assembled chair configuration of FIGS. 13-17 with the rotatable seat cradle 1 coupled to the yoke 50, the U-shaped base 52 lying at the bottom of yoke 50 runs underneath and laterally across the seat cradle to be connected to a plate 77 which is supported by the base 72 of the chair 75 at which the usual chair seat would have been connected had the chair seat not been replaced by the rotatable seat cradle 1 of this invention. The struts 54 which stand vertically upward from the base 52 run along respective side walls 8 and 10 of the seat cradle 1. The outstretched cradle supporting arms 56 which extend in the first direction from struts 54 are co-extensively and continuously connected to one another behind the lumbar supporting back 3 at the rear of seat cradle 1. Arm pads 60 against which the user can rest his arms while seated in cradle 1 are carried by the arm pad support braces 58 which extend from the struts 54 in the second direction.

A coupling hole 62 (best shown in FIG. 12) is formed through opposite sides of the yoke 50 at the intersection of the upturned struts 54 with the cradle supporting arms 56 and the arm pad supporting braces 58. A short stationary position limiting key 64 projects radially into each coupling hole 62 from a strut 54. A cylindrical coupling sleeve 66 (also best shown in FIG. 12) is attached (e.g., welded) to the outside of each upturned strut 54 of the yoke 50 so as to surround the coupling hole 62 formed therethrough.

A cradle position stopper (e.g., grommet) 68 having a notch 70 formed therein is dimensioned to be positioned through each coupling hole 62 for receipt in surrounding engagement and support by a cylindrical coupling sleeve 66. With the stopper 68 located within the coupling hole 62 and retained by sleeve 66, the stationary position limiting key 64 is correspondingly located in the notch 70 formed in the stopper. The cradle position stopper 68 may be formed from an elastomeric material having a spring memory for an advantage that will soon be explained. As is best shown in FIGS. 14 and 15, the cradle position stoppers 68 carried by the upturned struts 54 of the yoke 50 are affixed (e.g., adhesively bonded or pinned) to respective ones of the pivot support bushings 12 that are located on the outside of the side walls 8 and 10 of the rotatable seat cradle 1, whereby the cradle 1 is coupled to the yoke 50.

FIG. 13 shows a user seated within the rotatable seat cradle 1, the seat cradle pivotally coupled to the yoke 50, and the yoke fixedly connected to the chair 75 as previously explained. As was also previously explained and way of example, the chair 75 shown in FIG. 13 has a conventional base 72 and a set of rollers 73. The chair also has the aforementioned seat plate 77. However, instead of a seat to support the weight of the user, the combination rotatable seat cradle 1 and yoke 50 is connected to the base 72 of chair 70 at seat plate 77.

Figure 14:
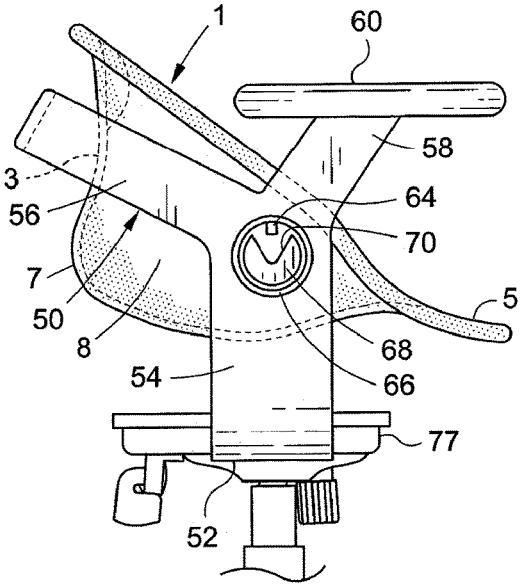
FIG. 14 is a side view of the rotatable seat cradle pivotally coupled to the yoke shown in FIG. 13 and rotated to a neutral seating position relative to the yoke.
Figure 15:
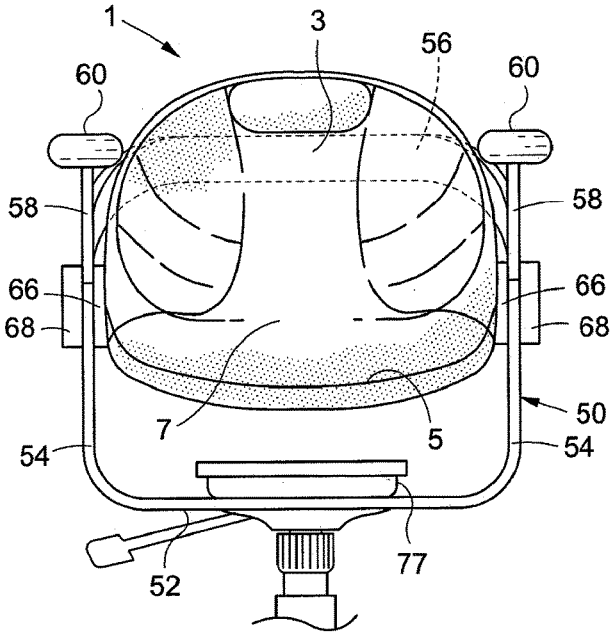
FIG. 15 is a top view of the rotatable seat cradle rotated to the neutral seating position as shown in FIG. 14.

FIGS. 13-15 show the seat cradle 1 located in the neutral (i.e., weight balanced) position. In this case, the stationary position limiting key 64 at each of the upturned struts 54 of the yoke 50 is located near the middle of the notch 70 formed in each cradle positioning stopper 68 adjacent opposite side walls 8 and 10 of cradle 1. It may be appreciated that the seat cradle 1 and the yoke 50 are coupled to one another so that the cradle position stoppers 68 which are connected to the cradle 1 at the pivot support bushings 12 thereof are rotatable within respective coupling holes 62 formed in the struts 54 of yoke 50. Thus, the seat cradle 1 is rotatable back and forth relative to the yoke 50 and the chair 70 to which the yoke 50 is fixedly connected.

Figure 16:
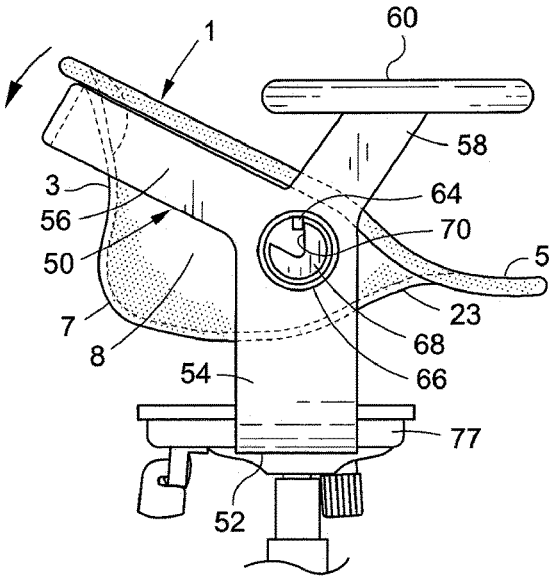
FIG. 16 is a side view of the rotatable seat cradle pivotally coupled to the yoke shown in FIG. 12 and rotated in a counter-clockwise direction relative to the yoke.

In this regard, FIG. 16 shows the seat cradle 1 rotated in a counter-clockwise direction with respect to the yoke 50 when the user shifts his weight backwards. In this case, the cradle position stoppers 68 located at opposite sides (only one of which 8 being visible) of the seat cradle 1 are rotated with the cradle 1 until each of the stationary position limiting keys (only one of which 64 being visible) engages one end of a corresponding stopper 68 at one end of the notch.

70. At the same time, the lumbar supporting back 3 of seat cradle 1 engages the outstretched cradle supporting arms 56 of the yoke 50 which are located behind the back 3. Additional rotation of the seat cradle 1 in the counter-clockwise direction of FIG. 16 is blocked by the simultaneous engagement of the stationary position limiting keys 64 by respective ones of the cradle position stoppers 68 and the lumbar supporting back 3 by the cradle supporting arms 56.

Figure 17:
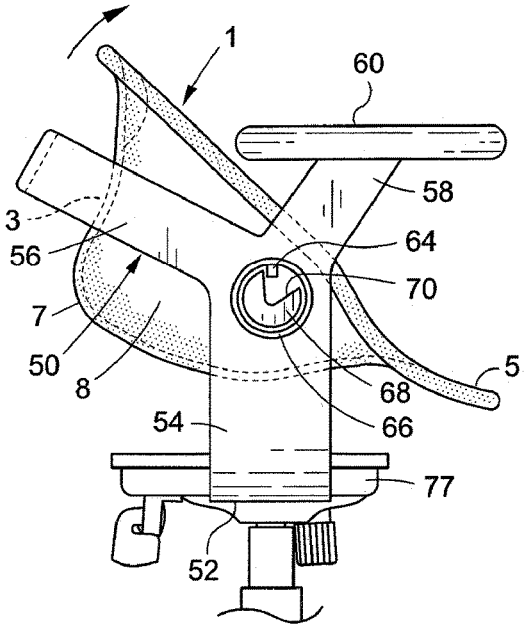
FIG. 17 is a side view of the rotatable seat cradle pivotally coupled to the yoke shown in FIG. 12 and rotated in a clockwise direction relative to the yoke.

FIG. 17 shows the seat cradle 1 rotated in a clockwise direction with respect to the yoke 50 when the user shifts his weight forwards. The cradle position stoppers 68 are now rotated with the seat cradle 1 until each stationary position limiting key 64 engages the opposite end of a corresponding cradle position stopper 68 at the opposite end of the notch 70 and the lumbar supporting back 3 of cradle 1 rotates away from the outstretched cradle supporting arms 56 of the yoke 50. Any additional rotation at the seat cradle 1 in the clockwise direction of FIG. 17 is blocked by the engagement of the stationary position limiting keys 64 by the cradle positioning stoppers 68.

As was indicated above, the cradle position stoppers 68 attached to opposite sides (e.g., 8) of the rotatable seat cradle 1 can be manufactured from an elastomeric material. In this case, when the cradle 1 is rotated in either of the counter-clockwise or clockwise directions of FIGS. 16 and 17, the stationary position limiting keys 64 are correspondingly pressed against one end of respective cradle positioning stoppers 68 which rotate into engagement therewith. Therefore, the stoppers 68 will be initially compressed and store energy. When the stoppers 68 expand, the spring memory characteristic thereof will urge the cradle 1 to rotate relative to the yoke 50 and towards the neutral position shown in FIGS. 13 and 14 when a user exits the cradle.

Regardless of its seating application, the rotatable seat cradle disclosed herein advantageously provides continuous support to the user's back while promoting seated neutral spine posture, dynamic anterior pelvic tilt, dynamic lumbar lordosis and a dynamic traction force applied to the user's lumbar spine so as to effectively unload the user's supper body weight from the user's seated pelvis, whereby to enable the user to experience maximum comfort especially at those times when he is leaning forward in the cradle.

What is claimed is:

1. A seat comprising:

a base;

a seat cradle connected to the base and having a back, a front, an intermediate bucket between the back and the front, and a pair of sides spaced from and lying opposite one another and extending between the back and the front, wherein, when the seat cradle is in the neutral position, the front of the seat cradle lies above a bottom of the intermediate bucket and has a sloping portion that extends upwardly from the intermediate bucket;

a yoke interconnecting a pair of upright struts, wherein the seat cradle is nested within and rotatable with respect to the yoke and the pair of upright struts, and wherein each of the pair of upright struts has a coupling hole formed therein; and a pair of cradle couplers, wherein each cradle coupler is a part of the seat cradle, wherein each cradle coupler is located within a respective coupling hole, such that the seat cradle is connected to the base by the pair of cradle couplers, with no locking means and not otherwise connected to the base, such that the seat cradle is suspended above a portion of the base, and wherein the cradle couplers are rotatable within respective ones of the coupling holes to establish pivots at which the seat cradle freely rotates when a user leans forward and back;

a limiter configured to limit rotation of the seat cradle between a first, rearward-most position and a second, forward-most position, wherein an upper portion of the back of the seat cradle projects inwardly, such that the upper portion of the back lies forward of a back of the intermediate bucket when the seat cradle is in the first, rearward-most position and when the seat cradle is in the second, forward-most position.

2. The seat recited in claim 1, wherein the pair of upright struts are connected to one another such that the yoke has a U-shape.

3. The seat recited in claim 1, wherein the coupling hole formed in each one of the pair of upright struts is located at an intersection of the one of the pair of upright struts with a cradle support arm.

4. The seat recited in claim 1, wherein the back and the intermediate bucket of the seat cradle form an acute angle.

5. The seat recited in claim 1, further comprising a plurality of rollers connected to the base.

6. The seat recited in claim 1, wherein the seat cradle further includes an upwardly sloping transition wall extending continuously and co-extensively between the intermediate bucket and the front.

7. The seat recited in claim 6, wherein the front of the seat cradle extends outwardly from the upwardly sloping transition wall, and wherein the upwardly sloping transition wall is joined to the front at a transition point spaced above a bottom of the intermediate bucket, the slope of the upwardly sloping transition wall making an angle of less than or equal to 45 degrees with a horizontal reference line through the transition point.

8. The seat recited in claim 1, further comprising a pair of coupling sleeves, each coupling sleeve surrounding a respective coupling hole.

9. The seat recited in claim 1, further comprising a pair of stationary position limiting keys, each stationary position limiting key being disposed in a respective coupling hole.

10. A seat comprising:

a support having a first coupling hole and a second coupling hole disposed therein;

a seat cradle having a back, a bottom that forms an acute angle with the back, a first side fixedly connected to the back and the bottom, and a second side fixedly connected to the back and the bottom, wherein the seat cradle has a neutral position in which a rear portion of the bottom is positioned below a forward portion of the bottom;

a first cradle coupler extending from the first side of the seat cradle, such that the first cradle coupler cannot rotate with respect to the first side; and a second cradle coupler extending from the second side of the seat cradle, such that the second cradle coupler cannot rotate with respect to the second side, wherein the first cradle coupler is received in the first coupling hole and the second cradle coupler is received in the second coupling hole, such that the seat cradle is connected to the support by the first cradle coupler and the second cradle coupler and with no locking means, and is not otherwise connected to the support, such that the seat cradle is suspended above a portion of the support, and such that the first and second cradle couplers freely rotate within the first and second coupling holes; and a limiter configured to limit rotation of the seat cradle between a first, rearward- most position and a second, forward-most position, wherein a top portion of the back of the seat cradle is positioned forward of a back portion of the bottom of the seat cradle when the seat cradle is in the first, rearward-most position and when the seat cradle is in the second, forward-most position.

11. The seat recited in claim 10, further comprising a first coupling sleeve surrounding the first coupling hole and a second coupling sleeve surrounding the second coupling hole.

12. The seat recited in claim 10, wherein the support includes a pair of cradle support arms extending in a rearward direction.

13. The seat recited in claim 10, wherein the support includes a yoke with a pair of upright struts.

14. The seat recited in claim 10, further comprising a first stationary position limiting key disposed in the first coupling hole, and a second stationary position limiting key disposed in the second coupling hole.

15. The seat recited in claim 13, wherein the seat cradle is nested within the yoke and the pair of upright struts.

16. The seat recited in claim 10, wherein the support includes a base.

17. The seat recited in claim 16, further comprising a plurality of rollers connected to the base.

* * * * *